US006467681B1

(12) United States Patent
Mori

(10) Patent No.: US 6,467,681 B1
(45) Date of Patent: Oct. 22, 2002

(54) TRANSPORTATION CONTAINER

(75) Inventor: Kiyoyoshi Mori, Tsushima (JP)

(73) Assignee: Toyota Tsusho Corporation, Nagoya (JP)

( * ) Notice: Subject to any disclaimer, the term of this patent is extended or adjusted under 35 U.S.C. 154(b) by 0 days.

(21) Appl. No.: 09/588,369

(22) Filed: Jun. 6, 2000

(30) Foreign Application Priority Data

Jun. 9, 1999 (JP) ..... 11-161820

(51) Int. Cl.[7] ..... B65D 21/02; B65D 43/06

(52) U.S. Cl. ..... 229/125.19; 206/505; 206/508; 206/516; 220/212; 220/380

(58) Field of Search ..... 229/114, 125.19; 206/505–508, 516; 220/212, 380, 625, 744

(56) References Cited

U.S. PATENT DOCUMENTS

| | | | | |
|---|---|---|---|---|
| 3,412,888 A | * | 11/1968 | Andrews et al. | 206/508 |
| 4,204,609 A | * | 5/1980 | Kuhn | 206/508 |
| 5,409,126 A | * | 4/1995 | DeMars | 206/508 |
| 5,499,715 A | * | 3/1996 | Nemeth | 206/516 |
| 5,769,229 A | * | 6/1998 | Andress et al. | 206/508 |

FOREIGN PATENT DOCUMENTS

| | | |
|---|---|---|
| DE | 1176051 | 8/1964 |
| DE | 4228819 A1 | 3/1994 |
| EP | 0579225 A2 | 1/1994 |
| GB | 2108933 A | 5/1983 |
| GB | 2152013 A | 7/1985 |
| JP | S47-21449 B | 6/1972 |

* cited by examiner

*Primary Examiner*—Gary E. Elkins
(74) *Attorney, Agent, or Firm*—Koda & Androlia

(57) ABSTRACT

A transportation container used for transportation of products includes a generally box-shaped body and a lid attached to the body. The body has a plurality of side walls and a bottom. The body has an open upper end with two pairs of corners. The side walls are inclined downwardly inward so that a cross-sectional area of the container is gradually decreased from the upper end to the bottom. The lid of one container is placed inside the body so as to support the bottom of another container and so as to define a space between the bottoms of the one and another containers when the another container is fitted into the one container to be put one upon the other.

4 Claims, 4 Drawing Sheets

TRANSPORTATION CONTAINER

BACKGROUND OF THE INVENTION

1. Field of the Invention

This invention relates to containers repeatedly used for transportation of products.

2. Description of the Prior Art

The prior art has provided a container of the above-mentioned type made of plastic and having side walls inclined downwardly inward so that a cross-sectional area thereof is gradually decreased from an open upper end to a bottom thereof. When not used for the product transportation, a plurality of the containers are fitted into one another to be laid one upon another while prevented from becoming bulky. Thus, the containers can be laid one upon another since the side walls thereof are inclined downwardly inward. However, the weight of the containers tightly engages one container with another when they are laid one upon another, whereupon the containers cannot easily be disengaged from one another.

SUMMARY OF THE INVENTION

Therefore, an object of the present invention is to provide a transportation container which can be prevented from being engaged tightly with one another such that the containers can easily be detached from one another when a plurality of the containers are laid one upon another.

The present invention provides a transportation container comprising a generally box-shaped body having a plurality of side walls and a bottom, the body having an open upper end with two pairs of corners, the side walls being inclined downwardly inward so that a cross-sectional area thereof is gradually decreased from the upper end to the bottom thereof, and a lid attached to the body so as to cover the open upper end of the body, the lid of one container being placed inside the body so as to support the bottom of another container and so as to define a space between the bottoms of said one and another containers when said another container is fitted into said one container to be put one upon the other.

According to the above-described container, when the lid of one container is placed inside the body thereof, the body of another container put onto said one container is supported by the lid. Consequently, even when a number of containers are laid one upon another, they can be prevented from being engaged tightly with one another and accordingly can easily be detached from one another.

In a preferred form, the lid includes a first lid portion covering a portion of the upper end of the body including one pair of corners and a second lid portion covering another portion of the upper end of the body including the other pair of corners, and the first and second lid portions have such respective complementary shapes as to be superposed on each other into a shape of a box. Since the paired lid portions are superposed one upon the other into the box shape, the strength of the lid can be increased and a number of container bodies can be supported.

In another preferred form, each of the first and second lid portions has a plurality of protrusions engaging an upper end of the body to thereby prevent the lid from falling off from the body. Since each lid portion is held on the upper end of the body by the protrusions, the container can be prevented from being spread or flexed due to the weight of the product accommodated in it.

BRIEF DESCRIPTION OF THE DRAWINGS

Other objects, features and advantages of the present invention will become clear upon understanding of the following description of the preferred embodiment, made with reference to the accompanying drawings, in which.

DETAILED DESCRIPTION OF THE PREFERRED EMBODIMENT

Figure 1:
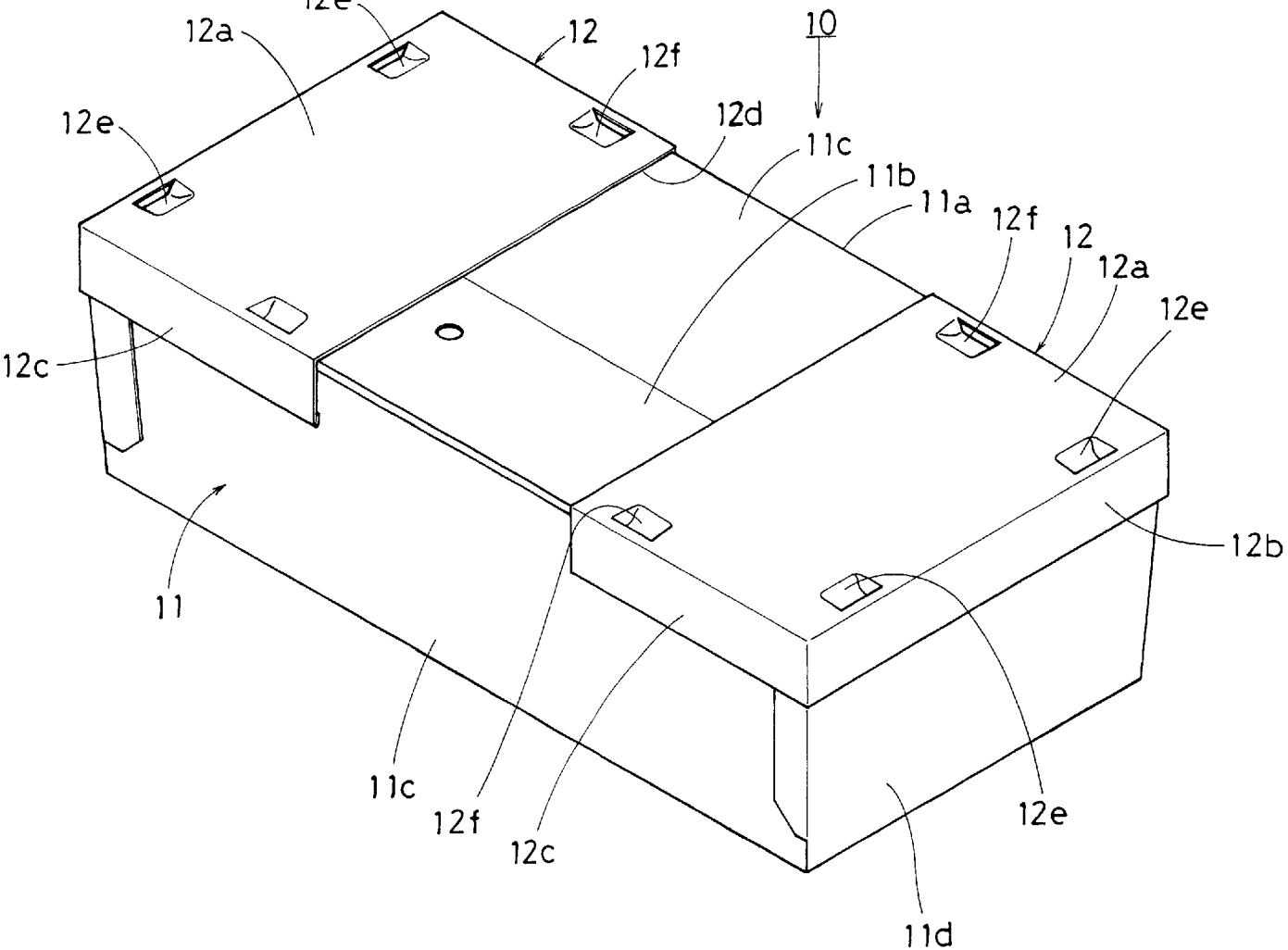
FIG. 1 is a perspective view of the container of one embodiment in accordance with the present invention.

One embodiment of the present invention will be described with reference to the accompanying drawings. Referring to FIG. 1, a container 10 in accordance with the invention is shown. The container 10 comprises a generally box-shaped rectangular body 11 made of a steel plate and a lid including a pair of lid portions 12 attached to the body. The body 11 includes two opposite long side walls 11*c*, two opposite short side walls 11*d*, and a bottom 11*b*. An open upper end 11*a* is defined by the side walls 11*c* and 11*d* so as to have two pair of corners. The lid portions 12 cover both lengthwise ends of the body 11 respectively. More specifically, one of the lid portions 12 covers a portion of the upper end 11*a* of the body 11 including one pair of corners, whereas the other lid portion 12 covers another portion of the upper end 11*a* of the body 11 including another pair of corners. The side walls 11*c* and 11*d* are inclined downwardly inward so that a cross-sectional area of the container 10 is gradually decreased from the open upper end 11*a* to the bottom 11*b*.

Each lid portion 12 is formed into the shape of a box and includes a rectangular lid body 12*a*, one long side wall 12*b* formed by bending one long side of the lid body and two short side walls 12*c* formed by bending two opposite short sides of the lid body respectively. Each lid portion 12 has an open end 12*d* opposite to the side wall 12*b*. Each lid portion 12 has on its inside two protrusions 12*e* formed near the long side wall 12*b* by means of pressing and two protrusions 12*f* formed near the respective short side walls 12*c* by means of pressing. A space is defined between the protrusions 12*e* and 12*f* and the side walls 12*c* and 12*d* of each lid portion 12. The upper end of the body 11 is inserted into the space when each lid portion 12 is attached to the body.

Figure 2:
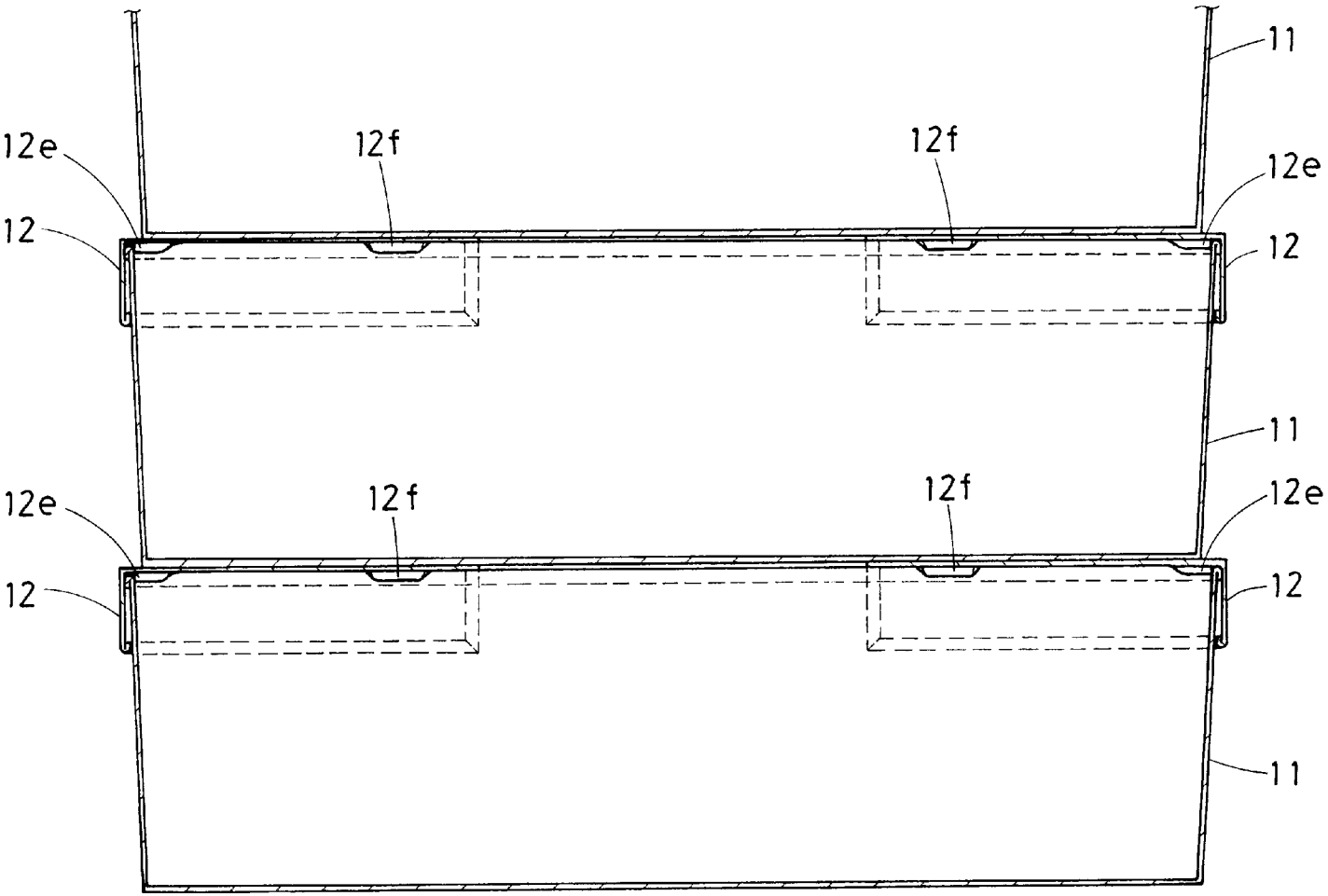
FIG. 2 is a sectional view of a plurality of containers laid one upon another when it is used for product transportation.

When products are put into the above-described container 10 for transportation, the lid portions 12 are attached to the lengthwise ends of the body 11 respectively as shown in FIG. 1. The container 10 is placed on another container 10 to be laid upon it as shown in FIG. 2. The protrusions 12*e* engage the upper end of the side wall 11*d* and the protrusions 12*f* engage the respective side walls 11*c* so that each lid portion 12 is prevented from falling off.

Figure 3:
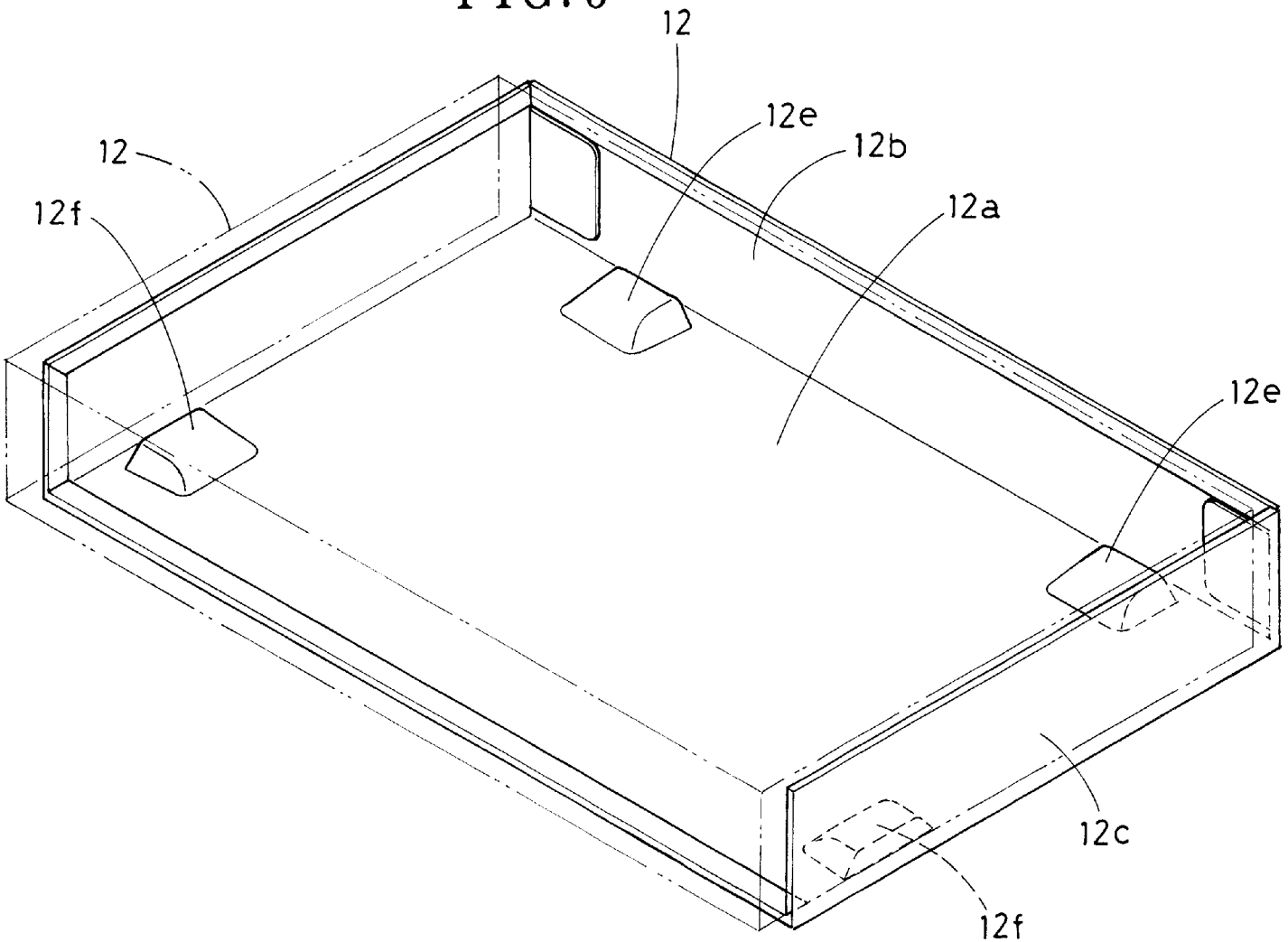
FIG. 3 is a perspective view of a lid of the container.
Figure 4:
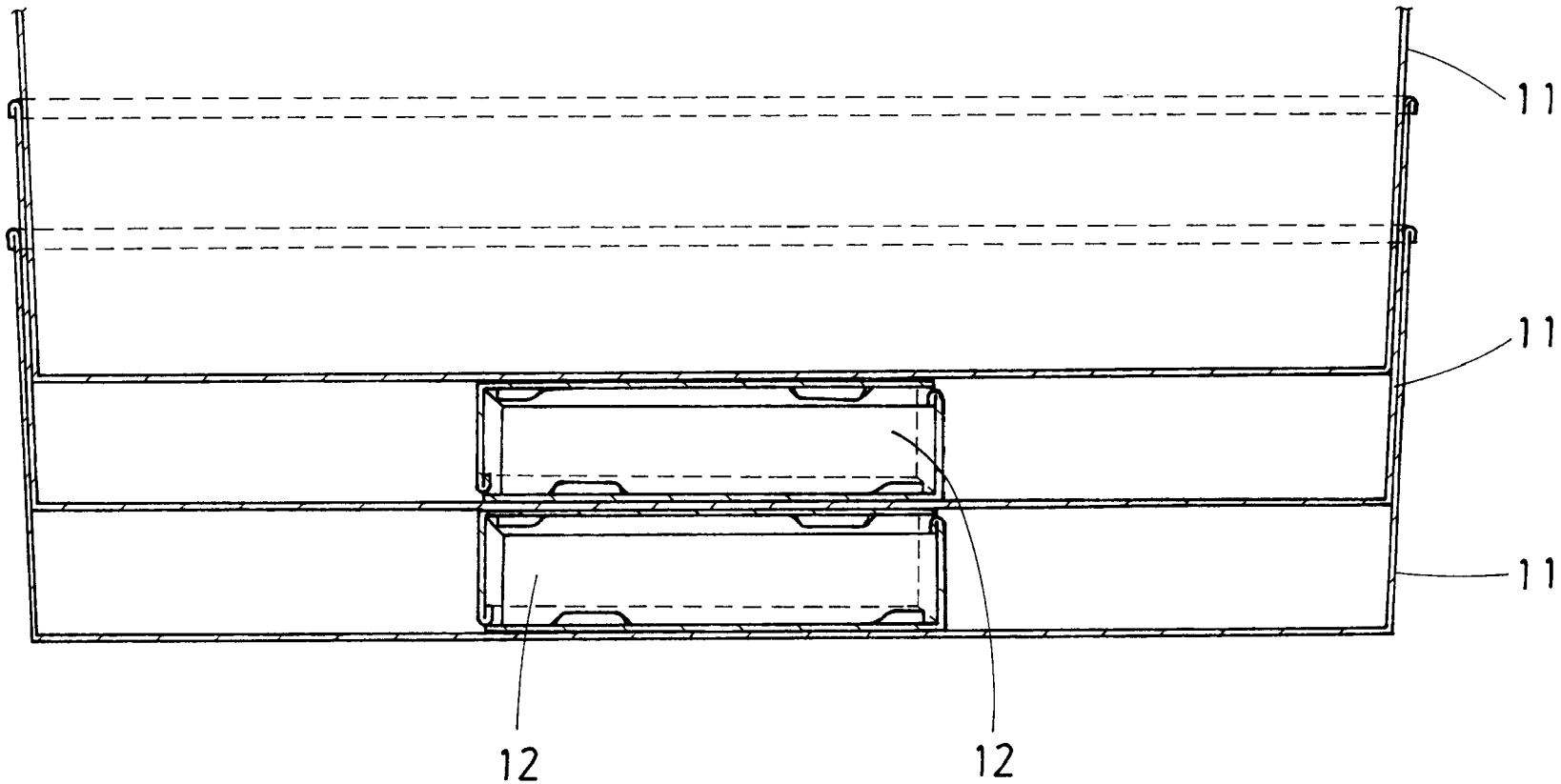
FIG. 4 is a sectional view of the containers laid one upon another when they are not used for product transportation.

Upon completion of the product transportation, the paired lid portions 12 are detached from the body 11. Then, the lid portions 12 are superposed together into the shape of a box so that the open end 12*d* of one lid portion 12 is covered by the side wall 12*b* of the other lid portion 12, as shown by solid line and two-dot chain line in FIG. 3. The lid portions 12 are then put into the body 11 as shown in FIG. 4. Other containers 10 are then fitted into the container 10 to be put one upon another. As a result, a predetermined space is defined between the bottom 11*b* of the body 11 of each container 10 and the bottom 11*b* of the body 11 of the container 10 which is put on said each container According to the above-described container 10, the lid portions 12 are put one upon the other and then put into the body 11 of the container 10. Another container 10 put onto the container 10 is supported on the lid portions 12 such that the space is defined between the bottoms 11*b* of the containers 10. Consequently, even when a number of containers 10 are laid one upon another, they can be prevented from being engaged tightly with one another and accordingly can easily be detached from one another.

Furthermore, the paired lid portions 12 have such respective complementary shapes that they are superposed into the shape of a box. Thus, the strength of each lid portion 12 can be increased when the lid portions 12 are superposed. Consequently, a number of containers 10 laid one upon another can be supported on the superposed lid portions 12 and the space can be defined between each container 10 and the one superposed on the former.

Additionally, the lid portions 12 are attached to the body 11 so as to cover the lengthwise ends of the upper end of the body respectively, whereupon each lid is held on the upper end of the body by the protrusions 12*e* and 12*f*. Consequently, the container can be prevented from being spread or flexed due to the weight of the product accommodated therein and accordingly can be used for transportation of heavy products.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A transportation container comprising:

a generally box-shaped body having a plurality of side walls and a bottom, the box-shaped body having an open upper end with two pairs of corners, the side walls being inclined downwardly inward so that a cross-sectional area thereof is gradually decreased from the upper end to the bottom thereof; and separate lid portions detachably coupled to the box-shaped body so as to cover the open upper end of the box-shaped body, the separate lid portions of the container being placed inside the box-shaped body on the bottom thereof so as to support a bottom of another box-shaped body of another container and so as to define a space between a bottom of a first container and a bottom of a second container when said second container is fitted into said first container to be put one within the other.

2. The transportation container according to claim 1, wherein the separate lid portions include a first lid portion covering a portion of the upper end of the box-shaped body including one of said two pairs of corners and a second lid portion covering another portion of the upper end of the box-shaped body including another one of said two pairs of corners, and the first and second lid portions have such respective complementary shapes so that when superposed on each other, the first and second lid portions form a box before being placed in said bottom of said box-shaped body.

3. The transportation container according to claim 2, wherein each of the first and second lid portions has a plurality of protrusions extending downwardly from a top surface of said first and second lid portions, said protrusions each engaging an inner side of said upper end of the box-shaped body to thereby prevent the lid from falling off from the box-shaped body when said first and second lid portions are placed to cover the open upper end of said box-shaped body.

4. The transportation container according to claim 3, wherein said protrusions are spaced from an inner side of a side wall of said separate lid portions by a distance substantially equal to a thickness of said side wall.

* * * * *